US010982329B2

(12) United States Patent
Terashima et al.

(10) Patent No.: US 10,982,329 B2
(45) Date of Patent: Apr. 20, 2021

(54) INSULATION-COATED ORIENTED MAGNETIC STEEL SHEET AND METHOD FOR MANUFACTURING SAME

(71) Applicant: JFE STEEL CORPORATION, Tokyo (JP)

(72) Inventors: Takashi Terashima, Tokyo (JP); Kazutoshi Hanada, Tokyo (JP); Ryuichi Suehiro, Tokyo (JP); Makoto Watanabe, Tokyo (JP); Toshito Takamiya, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 794 days.

(21) Appl. No.: 15/561,335

(22) PCT Filed: Mar. 11, 2016

(86) PCT No.: PCT/JP2016/057814
§ 371 (c)(1),
(2) Date: Sep. 25, 2017

(87) PCT Pub. No.: WO2016/158322
PCT Pub. Date: Oct. 6, 2016

(65) Prior Publication Data

US 2018/0087158 A1 Mar. 29, 2018

(30) Foreign Application Priority Data

Mar. 27, 2015 (JP) ..... JP2015-067017

(51) Int. Cl.
*C23C 22/33* (2006.01)
*C21D 9/46* (2006.01)
(Continued)

(52) U.S. Cl.
CPC ..... *C23C 22/33* (2013.01); *C21D 8/1283* (2013.01); *C21D 9/46* (2013.01); *C23C 22/74* (2013.01);
(Continued)

(58) Field of Classification Search
CPC ..... C23C 22/33; C23C 22/74; C23C 22/78; C23C 22/82; C21D 8/1283; C21D 9/46; H01F 27/245; H01F 41/0233
See application file for complete search history.

(56) References Cited

U.S. PATENT DOCUMENTS 3,856,568 A * 12/1974 Tanaka ..... H01F 1/14783 427/330
3,985,583 A 10/1976 Shimanaka et al.
(Continued)

FOREIGN PATENT DOCUMENTS

CN 104011246 A 8/2014
JP 4839338 A 6/1973
(Continued)

OTHER PUBLICATIONS

Translation—JP-H024924-B2; Osamu et al; Jan. 1990; (Year: 1990).*
(Continued)

*Primary Examiner* — Katherine A Bareford
*Assistant Examiner* — Christina D McClure
(74) *Attorney, Agent, or Firm* — Ratnerprestia

(57) ABSTRACT

Provided are an insulation-coated oriented magnetic steel sheet having an insulating coat with excellent heat resistance; and a method for manufacturing the same. This insulation-coated oriented magnetic steel sheet has an oriented magnetic steel sheet, and an insulating coat arranged on the surface of the oriented magnetic steel sheet, the insulating coat containing Si, P, O, and Cr, and at least one element selected from the group consisting of Mg, Ca, Ba,
(Continued)

Sr, Zn, Al, and Mn. The XPS spectrum of the outermost surface of the insulating coat has peaks observed at $Cr2p_{1/2}$ and $Cr2p_{3/2}$.

2 Claims, 2 Drawing Sheets

(51) Int. Cl.

| | |
|---|---|
| ***C21D 8/12*** | (2006.01) |
| ***C23C 22/74*** | (2006.01) |
| ***C23C 22/78*** | (2006.01) |
| ***C23C 22/82*** | (2006.01) |
| ***H01F 27/245*** | (2006.01) |
| *H01F 41/02* | (2006.01) |

(52) U.S. Cl.
CPC ..... *C23C 22/78* (2013.01); *C23C 22/82* (2013.01); *H01F 27/245* (2013.01); *H01F 41/0233* (2013.01)

(56) References Cited

U.S. PATENT DOCUMENTS

| | | | | |
|---|---|---|---|---|
| 4,772,338 | A * | 9/1988 | Fukuda | C21D 1/09 148/112 |
| 5,174,833 | A * | 12/1992 | Tanaka | C21D 8/1283 148/113 |
| 5,961,744 | A | 10/1999 | Yamazaki et al. | |
| 2009/0233114 | A1 | 9/2009 | Takeda et al. | |
| 2011/0039120 | A1 | 2/2011 | Fujii et al. | |
| 2011/0067786 | A1 | 3/2011 | Takashima et al. | |
| 2014/0352849 | A1 | 12/2014 | Suehiro et al. | |
| 2016/0230240 | A1 | 8/2016 | Senda et al. | |

FOREIGN PATENT DOCUMENTS

| | | | | |
|---|---|---|---|---|
| JP | 5079442 | A | 6/1975 | |
| JP | 6296617 | A | 5/1987 | |
| JP | S6296117 | A | 5/1987 | |
| JP | 024924 | A | 1/1990 | |
| JP | H024924 | B2 * | 1/1990 | |
| JP | 05287546 | A | 11/1993 | |
| JP | 05287546 | A * | 11/1993 | |
| JP | 0645824 | B2 | 6/1994 | |
| JP | 07188754 | A * | 7/1995 | H01F 1/14775 |
| JP | 07278830 | A | 10/1995 | |
| JP | 2004162112 | A | 6/2004 | |
| JP | 2011246782 | A * | 12/2011 | |
| JP | 5328375 | B2 | 10/2013 | |
| RU | 2407818 | C2 | 12/2010 | |
| RU | 2431697 | C1 | 10/2011 | |
| WO | 2015040799 | A1 | 3/2015 | |

OTHER PUBLICATIONS

JP-2011246782-A, machine translation, originally published 2011, p. 1-12 (Year: 2011).*
JP-07188754-A, machine translation, originally published 1995, p. 1-16 (Year: 1995).*
JP-05287546-A, machine translation, originally published 1993, p. 1-12 (Year: 1993).*
Russian Office Action for Russian Application No. 2017133479, dated Aug. 17, 2018, with translation, 11 pages.
Korean Office Action for Korean Application No. 10-2017-7025495, dated Dec. 19, 2018 with Concise Statement of Relevance of Office Action, 6 pages.
International Search Report and Written Opinion for International Application PCT/JP2016/057814, dated Apr. 12, 2016—7 Pages.
Japanese Office Action for Japanese Application No. 2016/534270, dated Jun. 27, 2017 with Concise Statement of Relevance of Office Action, 8 Pages.
Extended European Search Report for European Application No. 16772206.5, dated Nov. 24, 2017, 9 pages.
Japanese Office Action for Japanese Application No. 2016-534270, dated Nov. 28, 2017, including Concise Statement of Relevance of Office Action, 6 pages.
Concise Statement of Relevance of Office Action for Japanese Application No. 2016-534270, dated Jun. 27, 2017, 1 page.
Chinese Office Action with Search Report for Chinese Application No. 201680017173.1, dated Dec. 28, 2018, 11 pages.

* cited by examiner

INSULATION-COATED ORIENTED MAGNETIC STEEL SHEET AND METHOD FOR MANUFACTURING SAME

CROSS REFERENCE TO RELATED APPLICATIONS

This is the U.S. National Phase application of PCT/JP2016/057814, filed Mar. 11, 2016, which claims priority to Japanese Patent Application No. 2015-067017, filed Mar. 27, 2015, the disclosures of each of these applications being incorporated herein by reference in their entireties for all purposes.

TECHNICAL FIELD OF THE INVENTION

The present invention relates to a grain oriented electrical steel sheet with an insulating coating and a method of manufacturing the same.

BACKGROUND OF THE INVENTION

In general, a grain oriented electrical steel sheet (hereinafter also referred to simply as "steel sheet") is provided with a coating on its surface to impart insulation properties, workability, corrosion resistance and other properties. Such a surface coating includes an undercoating primarily composed of forsterite and forayed in final finishing annealing, and a phosphate-based top coating formed on the undercoating.

Of the coatings formed on the surface of the grain oriented electrical steel sheet, only the latter top coating is hereinafter called "insulating coating."

These coatings are formed at high temperature and further have a low coefficient of thermal expansion, and are therefore effective in imparting tension to the steel sheet owing to a difference in coefficient of thermal expansion between the steel sheet and the coatings when the temperature drops to room temperature, thus reducing iron loss of the steel sheet. Accordingly, the coatings are required to impart the highest possible tension to the steel.

In order to meet such a requirement, for example, Patent Literatures 1 and 2 disclose insulating coatings each formed using a treatment solution containing a phosphate (e.g., aluminum phosphate, magnesium phosphate), colloidal silica, and chromic anhydride.

The grain oriented electrical, steel sheet with an insulating coating may be hereinafter also simply called "grain oriented electrical steel sheet" or "steel sheet."

PATENT LITERATURE

Patent Literature 1: JP 48-39338 A
Patent Literature 2: JP 50-79442 A

SUMMARY OF THE INVENTION

Users of grain oriented electrical steel sheets, and in particular clients manufacturing wound-core transformers perform stress relief annealing at a temperature exceeding 800° C. after formation of cores for wound-core transformers through lamination of steel sheets to thereby release stress generated in the formation of the cores, thus eliminating deterioration of magnetic properties.

In this step, when the insulating coating is low in heat resistance, laminated steel sheets may stick to each other to lower the workability in the subsequent step. Sticking may also deteriorate magnetic properties.

The inventors of the present invention have studied the insulating coatings disclosed in Patent Literatures 1 and 2 and as a result found that sticking may not be adequately suppressed due to insufficient heat resistance.

The present invention has been made in view of the above and aims at providing a grain oriented electrical steel sheet with, an insulating coating having a highly heat-resistant insulating coating, and a method of manufacturing the same.

The inventors of the present invention have made an intensive study to achieve the above-described, object and as a result found that whether Cr bonded to another element is present at the outermost surface of an insulating coating has an influence on the level of heat resistance of the insulating coating, and also found a technique for making Cr bonded to another element be present at the outermost surface of the insulating coating. The present invention has been thus completed.

Specifically, the present invention includes providing the following (1) to (5).

(1) A grain oriented electrical steel sheet with an insulating coating, comprising: a grain oriented electrical steel sheet; and an insulating coating provided on a surface of the grain oriented electrical steel sheet, wherein the insulating coating contains at least one selected from the group consisting of Mg, Ca, Ba, Sr, Zn, Al and Mn, and Si, P, O and Cr, and wherein the insulating coating has an outermost surface that exhibits an XPS spectrum showing a $Cr2p_{1/2}$ peak and a $Cr2p_{3/2}$ peak.

(2) A method of manufacturing the grain oriented electrical steel sheet with an insulating coating according to (1) above, the grain oriented electrical steel sheet with an insulating coating being obtained by performing baking after applying a treatment solution to a surface of a grain oriented electrical steel sheet having undergone finishing annealing, wherein the treatment solution contains a phosphate of at least one selected from the group consisting of Mg, Ca, Ba, Sr, Zn, Al and Mn, colloidal silica, and a Cr compound, wherein a colloidal silica content in the treatment solution in terms of solid content is 50 to 150 parts by mass with respect to 100 parts by mass of total solids in the phosphate, wherein the Cr compound content in the treatment solution in terms of $CrO_3$ is 10 to 50 parts by mass with respect to 100 parts by mass of total solids in the phosphate, and wherein conditions of the baking in which a baking temperature T (unit: ° C.) ranges $850 \leq T \leq 1000$, a hydrogen concentration $H_2$ (unit: vol %) in a baking atmosphere ranges $0.3 \leq H_2 \leq 230-0.2\ T$, and a baking time Time (unit: s) at the baking temperature T ranges $5 \leq Time \leq 860-0.9\ T$ are met.

(3) The method of manufacturing the grain oriented electrical steel sheet with an insulating coating according to (2) above, wherein the grain oriented electrical steel sheet having undergone finishing annealing and having the treatment solution applied thereto is retained at a temperature of 150 to 450° C. for 10 seconds or more before being subjected to the baking.

(4) A method of manufacturing the grain oriented electrical steel sheet with an insulating coating according to (1) above, the grain oriented electrical steel sheet with an insulating coating being obtained by performing baking and plasma treatment in this order after applying a treatment solution to a surface of a grain oriented electrical steel sheet having undergone finishing annealing, wherein the treatment solution contains a phosphate of at, least, one selected from the group consisting of Mg, Ca, Ba, Sr, Zn, Al and Mn, colloidal silica, and a Cr compound, wherein a colloidal, silica content in the treatment solution in terms of solid content is 50 to 150 parts by mass with respect to 100 parts by mass of total solids in the phosphate, wherein the Cr compound content in the treatment solution in terms of $CrO_3$ is 10 to 50 parts by mass with respect to 100 parts by mass of total solids in the phosphate, and wherein conditions of the baking in which a baking temperature T (unit: ° C.) ranges $800 \leq T \leq 1000$, a hydrogen concentration $H_2$ (unit: vol %) in a baking atmosphere ranges $0 \leq H_2 \leq 230-0.2\ T$, and a baking time Time (unit: s) at the baking temperature T ranges $Time \leq 300$ are met, and wherein the plasma treatment is a treatment which includes irradiating the surface of the grain oriented electrical steel sheet after the baking with plasma generated from plasma gas containing at least 0.3 vol % of hydrogen for 0.10 seconds or more.

(5) The method of manufacturing the grain oriented electrical steel sheet with an insulating coating according to (4) above, wherein the grain oriented electrical steel sheet having undergone finishing annealing and having the treatment solution applied thereto is retained at a temperature of 150 to 450° C. for 10 seconds or more before being subjected to the baking and the plasma treatment.

The present invention has been made in view of the above and aims at providing a grain oriented electrical steel sheet with an insulating coating having a highly heat-resistant insulating coating, and a method of manufacturing the same.

DETAILED DESCRIPTION OF EMBODIMENTS OF THE INVENTION

[Findings Made by Inventors]

Figure 1:
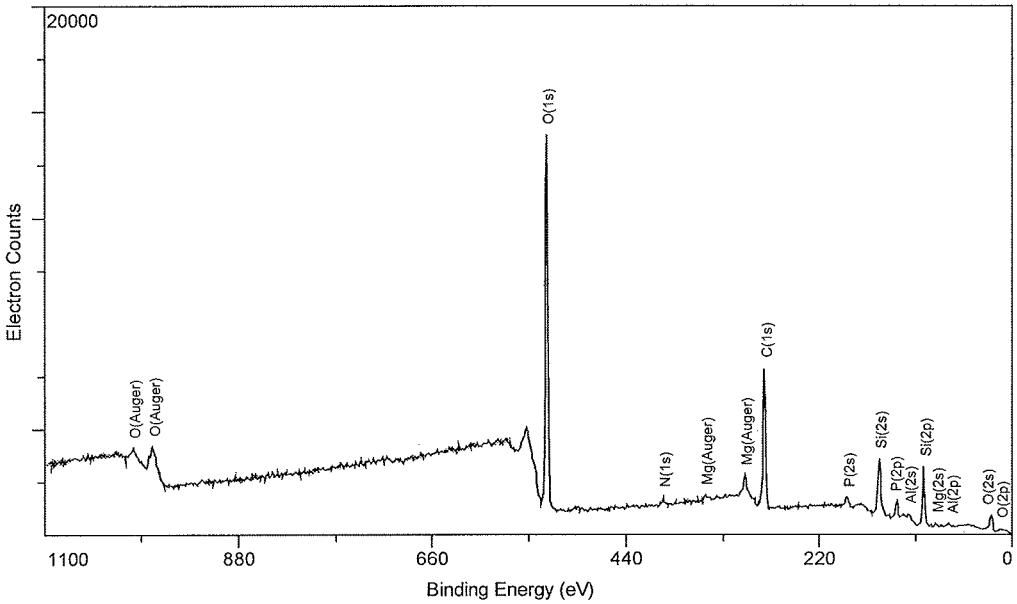
FIG. 1 is a graph showing an XPS wide spectrum of the outermost surface of an insulating coating A.

Findings from XPS analysis that have led the inventors to complete the present invention are first described.

A grain oriented electrical steel sheet that had been manufactured by a known method, had a sheet thickness of 0.23 mm, and had undergone finishing annealing was sheared to a size of 300 mm×100 mm, and an unreached annealing separator was removed. Thereafter, stress relief annealing (800° C., 2 hours, $N_2$ atmosphere) was performed.

Next, a treatment solution for insulating coating formation was applied to the steel sheet that had been slightly pickled in 5 mass % phosphoric acid. The treatment solution contained 100 parts by mass (in terms of solid content) of an aluminum primary phosphate aqueous solution, 80 parts by mass (in terms of solid content) of colloidal silica and 25 parts by mass (in terms of $CrO_3$) of a Cr compound, and the treatment solution was applied so that the coating amount on both surfaces after baking became 10 $g/m^2$.

The steel sheet to which the treatment solution had been applied was placed in a drying furnace, dried at 300° C. for 1 minute, and then baked at 850° C. for 1 minute in a 100% $N_2$ atmosphere, thereby obtaining a grain oriented electrical steel sheet with an insulating coating. For the sake of convenience, an insulating coating of the resulting steel sheet may also be referred to as "insulating coating A."

Next, the heat resistance of the insulating coating A was evaluated by a drop weight test. Specifically, each resulting steel sheet was sheared into specimens measuring 50 mm×50 mm, 10 specimens were stacked on top of one another, and annealing under a compressive load of 2 $kg/cm^2$ was performed in a nitrogen atmosphere at 830° C. for 3 hours. Then, a weight of 500 g was dropped from heights of 20 to 120 cm at intervals of 20 cm to evaluate the heat resistance of the insulating coating based on the height of the weight (drop height) at which the 10 specimens were all separated from each other. In a case in which the 10 specimens were all separated from each other after the annealing under compressive loading but before the drop weight test, the drop height was set to 0 cm.

When the specimens were separated from each other at a drop height of 40 cm or less, the insulating coating was rated as having excellent heat resistance. The insulating coating A showed a drop height of 100 cm and thus had poor heat resistance.

Subsequently, similarly to the case of the insulating coating A, a treatment solution for insulating coating formation was applied to the steel sheet that had been slightly pickled in 5 mass % phosphoric acid. The treatment solution contained 100 parts by mass (in terms of solid content) of a magnesium primary phosphate aqueous solution, 80 parts by mass (in terms of solid content) of colloidal silica and 25 parts by mass (in terms of $CrO_3$) of chromic anhydride as a Cr compound, and the treatment solution was applied so that the coating amount on both surfaces after baking became 10 $g/m^2$.

The steel sheet to which the treatment solution had been applied was placed in a drying furnace, dried at 300° C. for 1 minute, and then baked at 900° C. for 30 seconds in an atmosphere with a hydrogen concentration of 5 vol % (with the remainder being $N_2$), thereby obtaining a grain oriented electrical steel sheet with an insulating coating. For the sake of convenience, an insulating coating of the resulting steel sheet may also be referred to as "insulating coating B."

The heat resistance of the insulating coating B was evaluated by the drop weight test similarly to the insulating coating A, and it was confirmed that the insulating coating B showed a drop height of 20 cm and exhibited good heat resistance.

The insulating coating A and the insulating coating B which were thus different in drop height (heat resistance) were intensively studied for differences therebetween, and as a result it was found out that the insulating coatings have different XPS analysis values. This is described below.

The XPS analysis was performed on the insulating coating A by means of SSX-100 manufactured by SSI using AlKα line as the X-ray source. Specifically, first, the outermost surface of the insulating coating A was subjected to the XPS analysis. Next, the insulating coating A was sputtered with Ar ion beams, and the surface of the insulating coating A that had been exposed by scraping by 50 nm in the depth direction from the outermost surface was subjected to the XPS analysis. Results of the XPS analysis does not depend on the used device.

Figure 2:
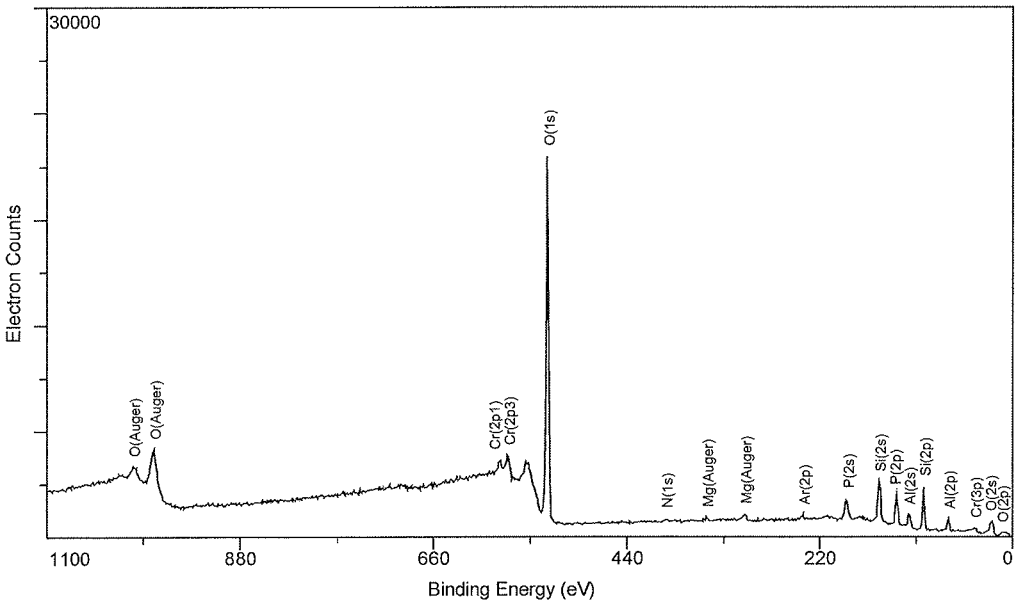
FIG. 2 is a graph showing an XPS wide spectrum of the surface of the insulating coating A that is exposed by scraping by 50 nm in the depth direction from the outermost surface.

FIG. 1 is a graph showing an XPS wide spectrum of the outermost surface of the insulating coating A. FIG. 2 is a graph showing an XPS wide spectrum of the surface of the insulating coating A that is exposed by scraping by 50 nm in the depth direction from the outermost surface.

As is evident from the graphs shown in FIGS. 1 and 2, in the insulating coating A, the presence of Cr was observed at a depth of 50 nm from the outermost surface (see FIG. 2), while the presence of Cr was not observed in the outermost surface (see FIG. 1) despite the fact that the insulating coating A was formed using the treatment solution containing $CrO_3$.

Next, the XPS analysis was performed on the insulating coating B similarly to the insulating coating A.

Figure 3:
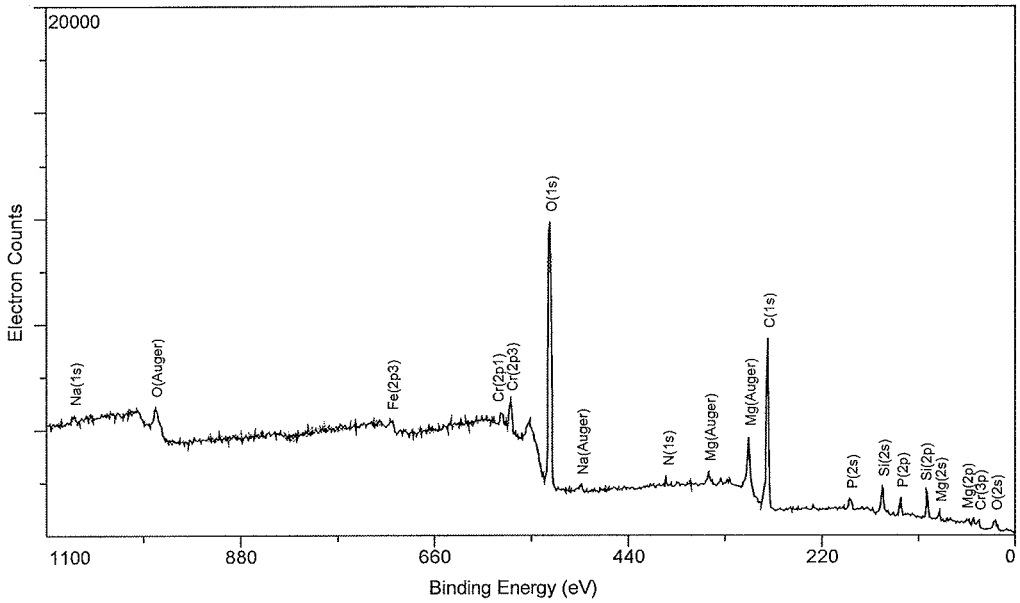
FIG. 3 is a graph showing an XPS wide spectrum of the outermost surface of an insulating coating B.
Figure 4:
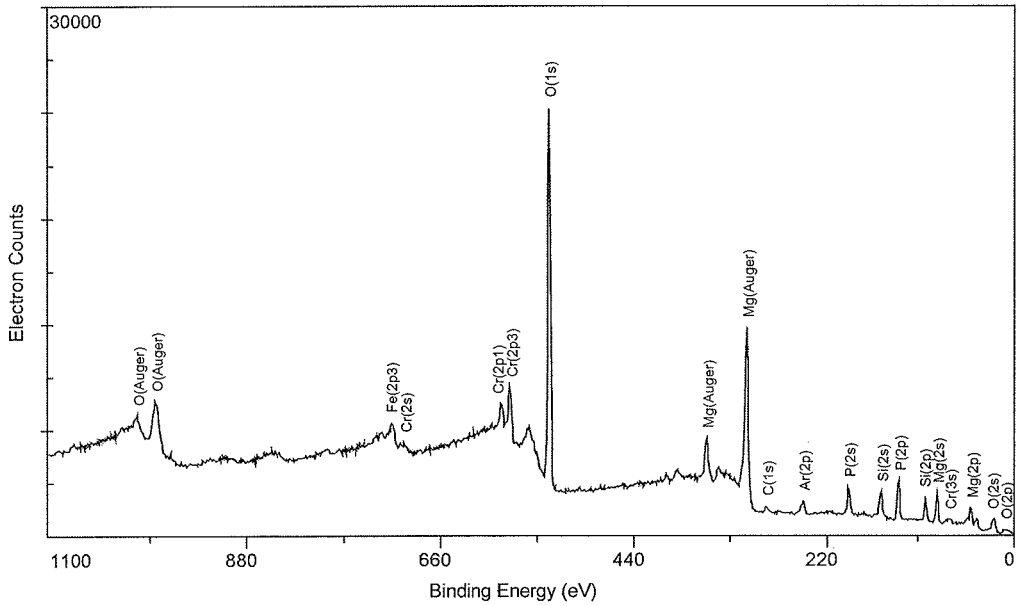
FIG. 4 is a graph showing an XPS wide spectrum of the surface of the insulating coating B that is exposed by scraping by 50 nm in the depth direction from the outermost surface.

FIG. 3 is a graph showing an XPS wide spectrum of the outermost surface of the insulating coating B. FIG. 4 is a graph showing an XPS wide spectrum of the surface of the insulating coating B that is exposed by scraping by 50 nm in the depth direction from, the outermost surface.

As is evident from the graphs shown in FIGS. 3 and 4, in the insulating coating B, the presence of Cr was observed not only at a depth of 50 nm from the outermost surface but also in the outermost surface. Specifically, the XPS spectrum in FIG. 3 shows a $Cr2p_{1/2}$ peak (represented by "Cr(2p1)" in FIG. 3) and a $Cr2p_{3/2}$ peak (represented by "Cr(2p3)" in FIG. 3).

The inventors consider the foregoing results as follows.

The mechanism of heat resistance improvement of an insulating coating formed from a treatment solution containing $CrO_3$ is probably as follows. It is presumed that bonding of Cr with another element strengthens the structure and increases the viscosity of a primarily glassy insulating coating at high temperature, whereby sticking is less likely to occur.

Meanwhile, the insulating coating A above corresponds to an insulating coating formed by any of the methods disclosed in, for instance, Patent Literatures 1 and 2. In the insulating coating A, Cr is not present in the outermost surface or, even if present, is not bonded with another element. This is probably the reason why the viscosity remains low at high temperature and sticking easily occurs.

In contrast, in the insulating coating B, Cr is present in the outermost surface and is bonded with another element (probably, mainly O); this is probably the reason why the viscosity increases at high temperature and sticking is less likely to occur.

Next, a grain oriented electrical steel sheet with an insulating coating according to an embodiment of the invention is described again before also describing its manufacturing method.

[Grain Oriented Electrical Steel Sheet with Insulating Coating]

The grain oriented electrical steel sheet with an insulating coating according to an embodiment of the invention (hereinafter also referred to simply as "grain oriented electrical steel sheet of the invention" or "steel sheet of the invention") includes a grain oriented electrical steel sheet; and an insulating coating provided on a surface of the grain oriented electrical steel sheet, wherein the insulating coating contains at least one selected from the group consisting of Mg, Ca, Ba, Sr, Zn, Al and Mn, and Si, P, O and Cr, and wherein the insulating coating has an outermost surface that exhibits an XPS spectrum showing a $Cr2p_{1/2}$ peak and a $Cr2p_{3/2}$ peak.

The grain oriented electrical steel sheet is not particularly limited but a conventionally known grain oriented electrical steel sheet may be used. The grain oriented electrical steel sheet is usually manufactured by a process which involves performing hot rolling of a silicon-containing steel slab by means of a known method, performing one cold rolling step or a plurality of cold rolling steps including intermediate annealing to finish the steel slab to a final thickness, thereafter performing primary recrystallization annealing, then applying an annealing separator, and performing final finishing annealing.

The presence of elements contained in the insulating coating can foe determined by XPS analysis. For example, the insulating coating according to an embodiment of the invention, which corresponds to the insulating coating B described above, has the XPS spectra showing Mg2s, Mg2p, P2s, P2p, O2s and other peaks (FIGS. 3 and 4). This reveals that the insulating coating contains, in addition to Cr, at least Mg, Si, P and O.

According to an embodiment of the invention, an insulating coating formed using a treatment solution containing a phosphate of at least one selected from the group consisting of Mg, Ca, Ba, Sr, Zn, Al and Mn, colloidal silica, and a Cr compound is deemed to contain at least, one selected from, the group consisting of Mg, Ca, Ba, Sr, Zn, Al and Mn, and Si, P, O and Cr.

The insulating coating according to an embodiment of the invention has the outermost surface that exhibits the XPS spectrum showing a $Cr2p_{1/2}$ peak and a $Cr2p_{3/2}$ peak (see FIG. 3). This represents excellent heat resistance.

[Method of Manufacturing Grain Oriented Electrical Steel Sheet with Insulating Coating]

Next, a method of manufacturing a grain oriented electrical steel sheet with an insulating coating according to the invention (hereinafter also referred to simply as "manufacturing method of the invention") that is for obtaining the steel sheet of the invention is described by way of embodiments.

First and second embodiments of the manufacturing method of the invention are now described.

First Embodiment

The first embodiment of the manufacturing method of the invention is a method of manufacturing the grain oriented electrical steel sheet with an insulating coating according to the invention, the grain oriented electrical steel sheet with an insulating coating being obtained by performing baking after applying a treatment solution to a surface of a grain oriented electrical steel sheet having undergone finishing annealing, wherein the treatment solution contains a phosphate of at least, one selected from the group consisting of Mg, Ca, Ba, Sr, Zn, Al and Mn, colloidal silica, and a Cr compound, wherein a colloidal silica content in the treatment solution in terms of solid content is 50 to 150 parts by mass with respect to 100 parts by mass of total solids in the phosphate, wherein a Cr compound content in the treatment solution in terms of $CrO_3$ is 10 to 50 parts by mass with respect to 100 parts by mass of total solids in the phosphate, and wherein conditions of the baking in which a baking temperature T (unit: ° C.) ranges $850 \leq T \leq 1000$, a hydrogen concentration $H_2$ (unit: vol %) in a baking atmosphere ranges $0.3 \leq H_2 \leq 230-0.2\ T$, and a baking time Time (unit: s) at the baking temperature T ranges $5 \leq Time \leq 860-0.8\ T$ are met.

<Treatment Solution>

The treatment solution is a treatment solution for forming the insulating coating that contains at least a phosphate of at least one selected from the group consisting of Mg, Ca, Ba, Sr, Zn, Al and Mn, colloidal silica, and a Cr compound.

(Phosphate)

The metal species of the phosphate is not particularly limited as long as at least one selected from the group consisting of Mg, Ca, Ba, Sr, Zn, Al and Mn is used. Phosphates of alkali metals (e.g., Li and Ma) are significantly inferior in heat resistance and moisture absorption resistance of a resulting insulating coating and hence inappropriate.

The phosphates may foe used singly or in combination of two or more. Physical property values of the resulting insulating coating can be precisely controlled by using two or more phosphates in combination.

A primary phosphate (biphosphate) is advantageously used as such a phosphate from the viewpoint of availability.

(Colloidal Silica)

The colloidal silica preferably has an average particle size of 5 to 200 nm, and more preferably 10 to 100 run front the viewpoint of availability and costs. The average particle size of the colloidal silica can be measured by the BET method (in terms of specific surface area obtained using an adsorption method). It is also possible to use instead an average value of actual measurement values on an electron micrograph.

The colloidal silica content in the treatment solution in terms of $SiO_2$ solid content is 50 to 150 parts by mass and preferably 50 to 100 parts by mass with respect to 100 parts by mass of total solids in the phosphate.

Too low a colloidal silica content may impair the effect of reducing the coefficient of thermal expansion of the insulating coating, thus reducing the tension to be applied to the steel sheet. On the other hand, too high a colloidal silica content may cause crystallization of the insulating coating to proceed easily at the time of baking to be described later, thus also reducing the tension to be applied to the steel sheet.

However, when the colloidal silica content is within the above-described range, the insulating coating imparts a proper tension to the steel sheet and is highly effective in improving the iron loss.

(Cr Compound)

An exemplary Cr compound contained in the treatment solution is a chromic acid compound, a specific example of which is at least one selected from the group consisting of chromic anhydride ($CrO_3$), a chromate and a bichromate.

Examples of metal species of chromates and bichromates include Na, K, Mg, Ca, Mn, Mo, Zn and Al.

Of these, chromic anhydride ($CrO_3$) is preferred for the Cr compound.

The Cr compound content in the treatment solution in terms of $CrO_3$ is 10 to 50 parts by mass and preferably 15 to 35 parts by mass with respect to 100 parts by mass of total solids in the phosphate.

When the Cr compound content is too low, sufficient heat resistance may not be obtained. On the other hand, when the Cr compound content is too high, a part of Cr atoms may become hexavalent chromium, which may not be favorable from the viewpoint of influence on a human body.

However, when the Cr compound content is within the above-described range, the insulating coating has sufficient heat resistance and is also favorable from the viewpoint of influence on a human body.

<Application of Treatment Solution>

The method of applying the above-described treatment solution to the surface of the grain oriented electrical steel sheet is not particularly limited but a conventionally known method may be used.

The treatment solution is preferably applied to both surfaces of the steel sheet and more preferably applied so that the coating amount on both the surfaces after baking becomes 4 to 15 g/m$^2$. The interlaminar insulation resistance may be reduced when the coating amount is too small, whereas the lamination factor may be more reduced when the coating amount is too large.

<Drying>

Since moisture dries in the temperature elevation process during baking, drying may not be separately performed before baking. However, the treatment solution is preferably sufficiently dried before baking and the grain oriented electrical steel sheet having the treatment solution applied thereto is more preferably dried (subjected to preliminary baking) before baking from the viewpoint of preventing poor film formation due to abrupt heating and also from the viewpoint that controlling the phosphate bonding state through reduction treatment of the insulating coating during baking, which is one characteristic feature of the invention, is stably performed.

To be more specific, for example, a steel sheet having the treatment solution applied thereto is preferably placed in a drying furnace and retained for drying at 150 to 450° C. for 10 seconds or more.

Under conditions of less than 150° C. and/or less than 10 seconds, drying may not be enough to obtain a desired binding state, and at a temperature higher than 450° C., the steel sheet may be oxidized during drying. In contrast, under conditions of 150 to 450° C. and 10 seconds or more, the steel sheet can be adequately dried while suppressing its oxidation.

A longer drying time is preferred but a drying time of 120 seconds or less is preferred because the productivity is easily reduced when the drying time exceeds 120 seconds.

<Baking>

Next, the grain oriented electrical steel sheet dried after application of the treatment solution is baked to form the insulating coating.

As described above, in order to obtain an insulating coating having excellent heat resistance, the insulating coating needs to have the outermost surface that exhibits an XPS spectrum showing a $Cr2p_{1/2}$ peak and a $Cr2p_{3/2}$ peak. The method of forming such an insulating coating is not particularly limited, and an exemplary method for obtaining the above-described XPS spectrum only needs to include specific conditions for baking. To be more specific, the conditions should include 1) a higher baking temperature (hereinafter denoted by "T"), 2) a higher hydrogen concentration thereinafter denoted by "$H_2$") in the baking atmosphere, and 3) a longer baking time (hereinafter denoted by "Time") at the baking temperature T.

The respective conditions are described below in further detail.

(Baking Temperature T)

The baking temperature T (unit: ° C.) is set in the range of $850 \leq T \leq 1000$. The baking temperature (T) is set to 850° C. or more so that the XPS spectrum of the outermost surface of the insulating coating shows a $Cr2p_{1/2}$ peak and a $Cr2p_{3/2}$ peak. On the other hand, when the baking temperature (T) is too high, crystallization of the primarily glassy insulating coating proceeds excessively to reduce the tension to be applied to the steel sheet. Therefore, the baking temperature is set to 1000° C. or less.

(Hydrogen Concentration $H_2$)

The hydrogen concentration Hg (unit: vol %) in the baking atmosphere is set in the range of $0.3 \leq H_2 \leq 230\text{-}0.2\ T$. The hydrogen concentration (Ha) is set to 0.3 vol % or more so that the XPS spectrum of the outermost surface of the insulating coating shows a $Cr2p_{1/2}$ peak and a $Cr2p_{3/2}$ peak. On the other hand, when the hydrogen concentration ($H_2$) is too high, crystallization of the primarily glassy insulating coating proceeds excessively. The limit concentration is related to the baking temperature (T) and is set in the range of $H_2 \leq 230\text{-}0.2\ T$.

The remainder of the baking atmosphere except hydrogen is preferably an inert gas, and more preferably nitrogen.

(Baking Time Time)

The baking time Time (unit: s) is set in the range of 5≤Time≤860-0.8 T. The baking time (Time) is set to 5 seconds or more so that the XPS spectrum of the outermost surface of the insulating coating shows a $Cr2p_{1/2}$ peak and a $Cr2p_{3/2}$ peak. On the other hand, when the baking time (Time) is too long, again, crystallization of the insulating coating proceeds excessively. The limit time is related to the baking temperature (T) and is set in the range of Time≤860-0.8 T.

Second Embodiment

Next, the manufacturing method of the invention is described with reference to the second embodiment.

In the foregoing first embodiment, a description was given of the specific baking conditions for forming, as an insulating coating having excellent heat resistance, the insulating coating having the outermost surface that exhibits an XPS spectrum showing a $Cr2p_{1/2}$ peak and a $Cr2p_{3/2}$ peak. However, even when the baking conditions in the first embodiment are not met, for example, for lack of the hydrogen concentration $H_2$, the same insulating coating as in the first embodiment is obtained by further performing plasma treatment under specific conditions.

More specifically, the second embodiment of the manufacturing method of the invention is a method of manufacturing the grain oriented electrical steel sheet with an insulating coating according to claim 1, the grain oriented electrical steel sheet with an insulating coating being obtained by performing baking and plasma treatment in this order after applying a treatment solution to a surface of a grain oriented electrical steel sheet having undergone finishing annealing, wherein the treatment solution contains a phosphate of at least one selected from the group consisting of Mg, Ca, Ba, Sr, Zn, Al and Mn, colloidal, silica, and a Cr compound, wherein a colloidal silica content in the treatment solution in terms of solid content is 50 to 150 parts by mass with respect to 100 parts by mass of total solids in the phosphate, wherein a Cr compound content in the treatment solution in terms of $CrO_3$ is 10 to 50 parts by mass with respect to 100 parts by mass of total solids in the phosphate, wherein conditions of the baking in which a baking temperature T (unit: ° C.) ranges 800≤T≤1000, a hydrogen concentration $H_2$ (unit: vol %) in a baking atmosphere ranges $0 \le H_2 \le 230-0.2$ T, and a baking time Time (unit: s) at the baking temperature T ranges Time≤300 are met, and wherein the plasma treatment is a treatment which includes irradiating the surface of the grain oriented electrical steel sheet after the baking with plasma generated from plasma gas containing at least 0.3 vol % of hydrogen for 0.10 seconds or more, Since conditions (treatment solution used, application method, and drying method) in the second embodiment are the same as those in the first embodiment except for baking and plasma treatment, their description is omitted.

<Baking>

In the second embodiment, it is found that plasma treatment is performed as the remedial treatment in the case where desired performance is not obtained, and acceptable ranges of the baking conditions are wider than those in the first embodiment. Even if the steel sheet obtained in the first embodiment of the manufacturing method of the invention is further subjected to plasma treatment, good performance is not impaired.

Specifically, as for the hydrogen concentration Hz (unit: vol %) in the baking atmosphere, $0.3 \le H_2 \le 230-0.2$ T is the met in the first embodiment but $0 \le H_2 \le 230-0.2$ T is set in the second embodiment. Good performance can be obtained even in the case of $0 \le H_2 < 0.3$ in which desired properties were not obtained according to the first embodiment.

The baking temperature T (unit: ° C.) can also be set in a wider range than under the conditions in the first embodiment (850≤T≤1000), and is in the range of 800≤T≤1000 in the second embodiment. In addition, the baking time Time (unit: s) at the baking temperature T is set in the range of Time≤300.

(Plasma Treatment)

As described above, even if the baking conditions do not meet the conditions in the first embodiment, an insulating coating having the outermost surface that exhibits an XPS spectrum showing a $Cr2p_{1/2}$ peak and a $Cr2p_{3/2}$ peak and thus having excellent heat resistance is obtained by further performing specific plasma treatment.

To be more specific, a surface of the grain oriented electrical steel sheet after the baking is irradiated with plasma generated from plasma gas containing at least 0.3 vol % of hydrogen for 0.10 seconds or more.

Plasma treatment is often performed in a vacuum, and vacuum plasma can be suitably used also in the present invention. However, the plasma treatment is not limited to this but, for example, atmospheric pressure plasma can also be used. Now simply referring to the atmospheric pressure plasma, the atmospheric pressure plasma is plasma generated under atmospheric pressure. The "atmospheric pressure" as used herein may be a pressure close to the atmospheric pressure, as exemplified by a pressure of $1.0 \times 10^4$ to $1.5 \times 10^5$ Pa.

For example, a radio frequency voltage is applied between opposed electrodes in the plasma gas (working gas) under atmospheric pressure to cause discharge to thereby generate plasma, and the surface of the steel sheet is irradiated with the plasma.

In this step, the plasma gas (working gas) is required to contain at least 0.3 vol % of hydrogen. When the hydrogen concentration is less than 0.3 vol %, excellent heat resistance is not obtained even after plasma treatment.

The upper limit of the hydrogen concentration in the plasma gas is not particularly limited, and is preferably 50 vol % or less and more preferably 10 vol % or less.

The gaseous remainder of the plasma gas except hydrogen preferably includes helium and argon because of easy plasma generation.

Plasma treatment is preferably performed after the temperature of the baked steal sheet dropped to 100° C. or less. In other words, it is preferable to irradiate the surface of the baked steel sheet whose temperature dropped to 100° C. or less with plasma. When the temperature is too high, the plasma generating portion may have a high temperature and this highly possibly causes a defect, but the defect can be suppressed at 100° C. or less.

The plasma irradiation time is set to 0.10 seconds or more because a beneficial effect is not obtained when the plasma irradiation time is too short. On the other hand, too long a plasma irradiation time does not cause a problem on the properties of the insulating coating, but the upper limit of the irradiation time is preferably 10 seconds or less from the viewpoint of productivity.

The plasma gas temperature (exit temperature) is preferably 200° C. or less, and more preferably 150° C. or less from the viewpoint that no thermal strain is applied to the steel sheet.

EXAMPLES

The present invention is specifically described below by way of examples. However, the present invention is not limited thereto.

Experimental Example 1

[Manufacture of Grain Oriented Electrical Steel Sheet with Insulating Coating]

A grain oriented electrical steel sheet with a sheet thickness of 0.23 mm (magnetic flux density $B_8$: 1.912 T) that had undergone finishing annealing was prepared. The steel sheet was cut into a size of 100 mm×300 mm and pickled in 5 mass % phosphoric, acid. Then, a treatment solution prepared by adding 80 parts by mass of colloidal silica (AT-30 manufactured by ADEKA Corporation; average particle size: 10 nm) and 25 parts by mass of chromic anhydride (in terms of $CrO_3$) as a Cr compound with respect to 100 parts by mass of one or more phosphates listed in Table 1 below was applied so that the coating amount on both surfaces after baking became 10 g/m$^2$, and the steel sheet was then placed in a drying furnace and dried at 300° C. for 1 minute, and thereafter baked under conditions shown in Table 1 below. A grain oriented electrical steel sheet with an insulating coating in each example was thus manufactured.

Each phosphate used was in the form of a primary phosphate aqueous solution, and Table 1 below showed the amounts in terms of solid content. The remainder of the baking atmosphere except hydrogen was set to nitrogen.

[ΔW]

In each example, the amount of change (ΔW) of iron loss was determined by an expression shown below. The results are shown in Table 1 below.

$$\Delta W = W_{17/50}(C) - W_{17/50}(R)$$

W17/50(C): iron loss immediately after baking

W17/50(R): iron loss immediately before applying the treatment solution (0.840 W/kg)

[Cr Peak]

For the grain oriented electrical steel sheet with an insulating coating in each example, the XPS wide spectrum of the outermost surface of an insulating coating was measured by means of SSX-100 manufactured by SSI using AlKα line as the X-ray source. The measured XPS wide spectrum was examined to check whether a $Cr2p_{1/2}$ peak and a $Cr2p_{3/2}$ peak were present. The results are shown in Table 1 below.

[Drop Height (Heat Resistance)]

The grain oriented electrical steel sheet with an insulating coating in each example was sheared into specimens measuring 50 mm×50 mm, 10 specimens were stacked on top of one another, and annealing under a compressive load of 2 kg/cm$^2$ was performed in a nitrogen, atmosphere at 830° C. for 3 hours. Then, a weight of 500 g was dropped from heights of 20 to 120 cm at intervals of 20 cm to evaluate the heat resistance of the insulating coating based on the height of the weight (drop height) at which the 10 specimens were all separated from each other. In a case in which the 10 specimens were all separated from each other after the annealing under compressive loading but before the drop weight test, the drop height was set to 0 cm. When the specimens were separated from each other at a drop height of 40 cm or less, the insulating coating was rated as having excellent heat resistance. The results are shown in Table 1 below.

[Lamination Factor]

The lamination factor of the grain oriented electrical steel sheet with an insulating coating in each example was determined according to JIS C 2550-5:2011. As a result, in every example, the insulating coating did not contain oxide fine particles or the like, and the lamination factor was therefore as good as 97.8% or more.

[Corrosion Resistance]

The rate of rusting of the grain oriented electrical steel sheet with an insulating coating in each example was determined after exposing the steel sheet to an atmosphere of 40° C. and 100% humidity for 50 hours. As a result, in every example, the rate of rusting was 1% or less, and the corrosion resistance was good.

TABLE 1

| | Phosphate [parts by mass] (in terms of solid content) | | | | | | | Baking condition | |
|---|---|---|---|---|---|---|---|---|---|
| No. | Magnesium phosphate | Calcium phosphate | Barium phosphate | Strontium phophate | Zinc phosphate | Aluminum phosphate | Manganese phosphate | T [° C.] | $H_2$ [vol %] |
| 1 | 100 | | | | | | | 800 | 0.3 |
| 2 | 100 | | | | | | | 850 | 0.0 |
| 3 | 100 | | | | | | | 850 | 0.3 |
| 4 | 100 | | | | | | | 850 | 0.3 |
| 5 | 100 | | | | | | | 850 | 0.0 |
| 6 | 100 | | | | | | | 850 | 0.3 |
| 7 | 100 | | | | | | | 900 | 0.3 |
| 8 | 100 | | | | | | | 900 | 0.3 |
| 9 | 100 | | | | | | | 900 | 5.0 |
| 10 | 100 | | | | | | | 850 | 20.0 |
| 11 | 100 | | | | | | | 850 | 60.0 |
| 12 | 100 | | | | | | | 900 | 10.0 |
| 13 | 100 | | | | | | | 900 | 50.0 |
| 14 | | | | | | 100 | | 800 | 30.0 |
| 15 | | | | | | 100 | | 900 | 0.0 |
| 16 | | | | | | 100 | | 900 | 40.0 |
| 17 | | | | | | 100 | | 900 | 40.0 |
| 18 | | | | | | 100 | | 950 | 20.0 |
| 19 | | | | | | 100 | | 950 | 40.0 |
| 20 | | | | | | 100 | | 1000 | 0.0 |
| 21 | | | | | | 100 | | 1000 | 30.0 |
| 22 | | | | | | 100 | | 1000 | 30.0 |
| 23 | | | | | | 100 | | 1000 | 30.0 |
| 24 | 40 | | | | | 60 | | 850 | 5.0 |

TABLE 1-continued

| | | | | | | | | | | |
|---|---|---|---|---|---|---|---|---|---|---|
| 25 | | 50 | | | | | 50 | | 850 | 40.0 |
| 26 | | | 100 | | | | | | 900 | 20.0 |
| 27 | | | | 100 | | | | | 900 | 10.0 |
| 28 | | | | | 100 | | | | 950 | 0.0 |
| 29 | 70 | | | | | | | 30 | 950 | 5.0 |
| 30 | 80 | 20 | | | | | | | 1000 | 0.3 |
| 31 | 50 | | | | | | 50 | | 1000 | 5.0 |
| 32 | 50 | | | | 50 | | | | 900 | 5.0 |
| 33 | | | 50 | 50 | | | | | 900 | 5.0 |
| 34 | 60 | | | | | | 40 | | 900 | 5.0 |

| | Baking condition | | | | Cr peak | | Drop | |
|---|---|---|---|---|---|---|---|---|
| | 230- | Time | 860- | ΔW | | | height | |
| No. | 0.2T | [s] | 0.8T | [W/kg] | $2p_{1/2}$ | $2p_{3/2}$ | [cm] | Remarks |
| 1 | 70 | 30 | 220 | −0.022 | Absent | Absent | 120 | CE |
| 2 | 60 | 30 | 180 | −0.031 | Absent | Absent | 100 | CE |
| 3 | 60 | 3 | 180 | −0.028 | Absent | Absent | 80 | CE |
| 4 | 60 | 5 | 180 | −0.029 | Present | Present | 40 | IE |
| 5 | 60 | 180 | 180 | −0.019 | Absent | Absent | 100 | CE |
| 6 | 60 | 30 | 180 | −0.022 | Present | Present | 40 | IE |
| 7 | 50 | 5 | 140 | −0.028 | Present | Present | 20 | IE |
| 8 | 50 | 30 | 140 | −0.035 | Present | Present | 20 | IE |
| 9 | 50 | 30 | 140 | −0.028 | Present | Present | 0 | IE |
| 10 | 60 | 30 | 180 | −0.029 | Present | Present | 20 | IE |
| 11 | 60 | 30 | 180 | −0.035 | Present | Present | 0 | IE |
| 12 | 50 | 30 | 140 | −0.028 | Present | Present | 0 | IE |
| 13 | 50 | 30 | 140 | −0.028 | Present | Present | 0 | IE |
| 14 | 70 | 30 | 220 | −0.035 | Absent | Absent | 100 | CE |
| 15 | 50 | 30 | 140 | −0.032 | Absent | Absent | 80 | CE |
| 16 | 50 | 30 | 140 | −0.033 | Present | Present | 40 | IE |
| 17 | 50 | 5 | 140 | −0.028 | Present | Present | 40 | IE |
| 18 | 40 | 30 | 100 | −0.032 | Present | Present | 20 | IE |
| 19 | 40 | 30 | 100 | −0.032 | Present | Present | 20 | IE |
| 20 | 30 | 30 | 60 | −0.025 | Absent | Absent | 60 | CE |
| 21 | 30 | 2 | 60 | −0.026 | Absent | Absent | 60 | CE |
| 22 | 30 | 5 | 60 | −0.028 | Present | Present | 40 | IE |
| 23 | 30 | 30 | 60 | −0.029 | Present | Present | 20 | IE |
| 24 | 60 | 180 | 180 | −0.018 | Present | Present | 20 | IE |
| 25 | 60 | 20 | 180 | −0.029 | Present | Present | 20 | IE |
| 26 | 50 | 10 | 140 | −0.028 | Present | Present | 40 | IE |
| 27 | 50 | 140 | 140 | −0.019 | Present | Present | 20 | IE |
| 28 | 40 | 10 | 100 | −0.032 | Absent | Absent | 100 | CE |
| 29 | 40 | 100 | 100 | −0.028 | Present | Present | 20 | IE |
| 30 | 30 | 60 | 60 | −0.018 | Present | Present | 40 | IE |
| 31 | 30 | 30 | 60 | −0.028 | Present | Present | 20 | IE |
| 32 | 50 | 10 | 140 | −0.032 | Present | Present | 40 | IE |
| 33 | 50 | 30 | 140 | −0.035 | Present | Present | 20 | IE |
| 34 | 50 | 60 | 140 | −0.032 | Present | Present | 20 | IE |

CE: Comparative Example
IE: Inventive Example

As shown in Table 1 above, it was revealed that the insulating films in Inventive Examples in each of which the XPS spectrum shows a $Cr2p_{1/2}$ peak and a $Cr2p_{3/2}$ peak have excellent heat resistance.

Experimental Example 2

A grain oriented electrical steel sheet with a sheet thickness of 0.23 mm (magnetic flux density $B_8$: 1.912 T) that had undergone finishing annealing was prepared. The steel sheet was cut into a size of 100 mm×300 mm and pickled in 5 mass % phosphoric acid. Then, a treatment solution prepared by adding 60 parts by mass of colloidal silica (SNOWTEX 50 manufactured by Nissan Chemical Industries, Ltd.; average particle size: 30 nm) and 30 parts by mass of chromic anhydride (in terms of $CrO_3$) as a Cr compound with respect to 100 parts by mass of one or more phosphates listed in Table 2 below was applied so that the coating amount on both surfaces after baking became 10 g/m$^2$, and the steel sheet was then placed in a drying furnace and dried at 300° C. for 1 minute, and thereafter subjected to baking and plasma treatment under conditions shown in Table 2 below. A grain oriented electrical steel sheet with an insulating coating in each example was thus manufactured.

Each phosphate used was in the form of a primary phosphate aqueous solution, and Table 2 below showed the amounts in terms of solid content. The remainder of the baking atmosphere except hydrogen was set to nitrogen.

At the beginning of plasma treatment, the steel sheet temperature after baking was room temperature.

In plasma treatment, the steel sheet was irradiated with atmospheric pressure plasma. The atmospheric pressure plasma device used was PF-DFL manufactured by Plasma Factory Co., Ltd., and the plasma head used was a linear plasma bead having a width of 300 mm.

The gas species of the plasma gas (working gas) included Ar, Ar—$N_2$, or Ar—$H_2$, and the total flow rate was set to 30 L/min.

The plasma width was set to 3 mm. The plasma head was fixed and the steel sheet conveying speed was varied to vary the irradiation time to thereby uniformly perform plasma treatment on the entire surface of the steel sheet. The irradiation time was calculated by dividing the plasma width (3 mm) by the conveyance speed (unit: mm/s).

[ΔW]

In each example, the amount of change (ΔW) of iron loss was determined by an expression shown below. The results are shown in Table 2 below.

$$\Delta W = W_{17/50}(P) - W_{17/50}(R)$$

$W_{17/50}(P)$: iron loss immediately after plasma treatment $W_{17/50}(R)$: iron loss immediately before applying the treatment solution (0.840 W/kg)

[Cr Peak]

The XPS wide spectrum of the outermost surface of an insulating coating in each example was measured by means of SSX-X00 manufactured by SSI using AlKα line as the X-ray source. The measured XPS wide spectrum was examined to check whether a $Cr2p_{1/2}$ peak and a $Cr2p_{3/2}$ peak were present.

In each example of Experimental Example 2, measurement was made before and after plasma irradiation in plasma treatment. The results are shown in Table 2 below.

Since the case where either of the two peaks was solely seen was not observed in any of the measurements, the presence or absence of the peaks is simply stated in Table 2 below without distinguishing the two peaks.

[Drop Height (Heat Resistance)]

The grain oriented electrical steel sheet with an insulating coating in each example was sheared into specimens measuring 50 mm×50 mm, 10 specimens were stacked on top of one another, and annealing under a compressive load of 2 kg/cm$^2$ was performed in a nitrogen atmosphere at 830° C. for 3 hours. Then, a weight of 500 g was dropped from heights of 20 to 120 cm at intervals of 20 cm to evaluate the heat resistance of the insulating coating based on the height of the weight (drop height) at which the 10 specimens were ail separated from each other. In a case in which the 10 specimens were all separated from each other after the annealing under compressive loading but before the drop weight test, the drop height was set to 0 cm. When the specimens were separated from each other at a drop height of 40 cm or less, the insulating coating was rated as having excellent heat resistance. The results are shown in Table 2 below.

[Lamination Factor]

The lamination factor of the grain oriented electrical steel sheet with an insulating coating in each example was determined according to JIS C 2550-5:2011. As a result, in every example, the insulating coating did not contain oxide fine particles or the like, and the lamination factor was therefore as good as 97.8% or more.

[Corrosion Resistance]

The rate of rusting of the grain oriented electrical steel sheet with an insulating coating in each example was determined after exposing the steel sheet to an atmosphere of 40° C. and 100% humidity for 50 hours. As a result, in every example, the rate of rusting was 1% or less, and the corrosion resistance was good.

TABLE 2

| | Phosphate [parts by mass] (in terms of solid content) | | | | | | | Baking condition | | | |
|---|---|---|---|---|---|---|---|---|---|---|---|
| No. | Magnesium phosphate | Calcium phosphate | Barium phosphate | Strontium phophate | Zinc phosphate | Aluminum phosphate | Manganese phosphate | T [° C.] | $H_2$ [Vol %] | 230-0.2T | Time [s] |
| 1 | 100 | | | | | | | 800 | 0.0 | 70 | 30 |
| 2 | 100 | | | | | | | 800 | 0.0 | 70 | 30 |
| 3 | 100 | | | | | | | 800 | 0.0 | 70 | 30 |
| 4 | 100 | | | | | | | 900 | 0.2 | 50 | 120 |
| 5 | 100 | | | | | | | 800 | 0.0 | 70 | 30 |
| 6 | 100 | | | | | | | 800 | 0.0 | 70 | 30 |
| 7 | 100 | | | | | | | 800 | 0.0 | 70 | 30 |
| 8 | 100 | | | | | | | 800 | 0.2 | 70 | 3 |
| 9 | 100 | | | | | | | 800 | 0.0 | 70 | 30 |
| 10 | 100 | | | | | | | 850 | 0.1 | 60 | 20 |
| 11 | 100 | | | | | | | 800 | 0.0 | 70 | 30 |
| 12 | 100 | | | | | | | 800 | 0.0 | 70 | 30 |
| 13 | 100 | | | | | | | 1000 | 0.1 | 30 | 60 |
| 14 | | | | | | 100 | | 850 | 0.0 | 60 | 60 |
| 15 | | | | | | 100 | | 850 | 0.1 | 60 | 60 |
| 16 | | | | | | 100 | | 850 | 0.2 | 60 | 60 |
| 17 | | | | | | 100 | | 900 | 0.2 | 50 | 60 |
| 18 | | | | | | 100 | | 950 | 0.2 | 40 | 60 |
| 19 | | | | | | 100 | | 950 | 0.0 | 40 | 30 |
| 20 | | | | | | 100 | | 1000 | 0.0 | 30 | 30 |
| 21 | | | | | | 100 | | 1000 | 0.0 | 30 | 5 |
| 22 | | | | | | 100 | | 1000 | 0.1 | 30 | 3 |
| 23 | | | | | | 100 | | 1000 | 0.0 | 30 | 3 |
| 24 | 40 | | | | | 60 | | 800 | 0.0 | 70 | 30 |
| 25 | | 50 | | | | 50 | | 800 | 0.0 | 70 | 30 |
| 26 | | | 100 | | | | | 800 | 0.2 | 70 | 3 |
| 27 | | | | 100 | | | | 800 | 0.0 | 70 | 30 |
| 28 | | | | | 100 | | | 800 | 0.0 | 70 | 30 |
| 29 | 70 | | | | | | 30 | 1000 | 0.0 | 30 | 5 |
| 30 | 80 | 20 | | | | | | 850 | 0.1 | 60 | 2 |
| 31 | 50 | | | | | 50 | | 850 | 0.2 | 60 | 60 |
| 32 | 50 | | | | 50 | | | 950 | 0.1 | 40 | 30 |
| 33 | | | 50 | 50 | | | | 1000 | 0.1 | 30 | 30 |
| 34 | 60 | | | | | 40 | | 1000 | 0.0 | 30 | 120 |

TABLE 2-continued

| | Plasma treatment condition | | | | | | Cr peak | | Drop | |
|---|---|---|---|---|---|---|---|---|---|---|
| No. | Ar [L/min] | $N_2$ [L/min] | $H_2$ [L/min] | $H_2$ [Vol %] | Irradiation time [s] | ΔW [W/kg] | Before irradiation | After irradiation | height [cm] | Remarks |
| 1 | 30.0 | 0 | 0 | 0.0 | 3.00 | −0.022 | Absent | Absent | 120 | CE |
| 2 | 29.9 | 0.1 | 0 | 0.0 | 3.00 | −0.023 | Absent | Absent | 100 | CE |
| 3 | 29.5 | 0.5 | 0 | 0.0 | 3.00 | −0.025 | Absent | Absent | 120 | CE |
| 4 | 28.5 | 1.5 | 0 | 0.0 | 3.00 | −0.026 | Absent | Absent | 120 | CE |
| 5 | 28.0 | 2.0 | 0 | 0.0 | 5.00 | −0.022 | Absent | Absent | 100 | CE |
| 6 | 29.9 | 0 | 0.1 | 0.3 | 0.05 | −0.022 | Absent | Absent | 80 | CE |
| 7 | 29.9 | 0 | 0.1 | 0.3 | 0.10 | −0.024 | Absent | Present | 40 | IE |
| 8 | 29.9 | 0 | 0.1 | 0.3 | 1.00 | −0.026 | Absent | Present | 40 | IE |
| 9 | 29.9 | 0 | 0.1 | 0.3 | 3.00 | −0.028 | Absent | Present | 20 | IE |
| 10 | 29.7 | 0 | 0.3 | 1.0 | 3.00 | −0.029 | Absent | Present | 20 | IE |
| 11 | 29.5 | 0 | 0.5 | 1.7 | 3.00 | −0.025 | Absent | Present | 20 | IE |
| 12 | 28.5 | 0 | 1.5 | 5.0 | 5.00 | −0.023 | Absent | Present | 0 | IE |
| 13 | 29.9 | 0 | 0.1 | 0.3 | 3.00 | −0.029 | Absent | Present | 40 | IE |
| 14 | 29.9 | 0 | 0.1 | 0.3 | 3.00 | −0.035 | Absent | Present | 40 | IE |
| 15 | 29.9 | 0 | 0.1 | 0.3 | 3.00 | −0.032 | Absent | Present | 40 | IE |
| 16 | 29.9 | 0 | 0.1 | 0.3 | 3.00 | −0.033 | Absent | Present | 40 | IE |
| 17 | 29.9 | 0 | 0.1 | 0.3 | 3.00 | −0.031 | Absent | Present | 40 | IE |
| 18 | 29.9 | 0 | 0.1 | 0.3 | 3.00 | −0.032 | Absent | Present | 20 | IE |
| 19 | 29.9 | 0 | 0.1 | 0.3 | 3.00 | −0.032 | Absent | Present | 40 | IE |
| 20 | 29.9 | 0 | 0.1 | 0.3 | 3.00 | −0.028 | Absent | Present | 40 | IE |
| 21 | 29.9 | 0 | 0.1 | 0.3 | 3.00 | −0.029 | Absent | Present | 40 | IE |
| 22 | 29.9 | 0 | 0.1 | 0.3 | 3.00 | −0.031 | Absent | Present | 40 | IE |
| 23 | 29.9 | 0 | 0.1 | 0.3 | 3.00 | −0.029 | Absent | Present | 40 | IE |
| 24 | 29.9 | 0.1 | 0 | 0.0 | 3.00 | −0.023 | Absent | Absent | 120 | CE |
| 25 | 28.0 | 2.0 | 0 | 0.0 | 5.00 | −0.028 | Absent | Absent | 120 | CE |
| 26 | 29.9 | 0 | 0.1 | 0.3 | 1.00 | −0.022 | Absent | Present | 40 | IE |
| 27 | 29.5 | 0 | 0.5 | 1.7 | 3.00 | −0.023 | Absent | Present | 20 | IE |
| 28 | 28.5 | 0 | 1.5 | 5.0 | 5.00 | −0.023 | Absent | Present | 20 | IE |
| 29 | 29.9 | 0 | 0.1 | 0.3 | 3.00 | −0.028 | Absent | Present | 20 | IE |
| 30 | 29.8 | 0 | 0.1 | 0.3 | 0.05 | −0.032 | Absent | Absent | 100 | CE |
| 31 | 29.9 | 0 | 0.1 | 0.3 | 0.05 | −0.034 | Absent | Absent | 120 | CE |
| 32 | 29.9 | 0 | 0.1 | 0.3 | 0.05 | −0.031 | Absent | Absent | 120 | CE |
| 33 | 29.9 | 0 | 0.1 | 0.3 | 0.05 | −0.029 | Absent | Absent | 120 | CE |
| 34 | 29.9 | 0 | 0.1 | 0.3 | 3.00 | −0.027 | Absent | Present | 20 | IE |

CE: Comparative Example
IE: Inventive Example

As shown in Table 2 above, it was revealed that, even when a $Cr2p_{1/2}$ peak and a $Cr2p_{3/2}$ peak did not appear after baking, the two peaks were observed owing to the subsequent plasma treatment, and excellent heat resistance was obtained.

The invention claimed is:

1. A method of manufacturing a grain oriented electrical steel sheet with an insulating coating comprising;

a grain oriented electrical steel sheet; and an insulating coating provided on a surface of the grain oriented electrical steel sheet, wherein the insulating coating contains at least one selected from the group consisting of Ma, Ca, Ba, Sr, Zn, Al and Mn, and Si, P, O and Cr, and wherein the insulating coating has an outermost surface that exhibits an XPS spectrum showing a $Cr2p_{1/2}$ peak and a $Cr2p_{3/2}$ peak, the grain oriented electrical steel sheet with the insulating coating being obtained by performing baking and plasma treatment in this order after applying a treatment solution to a surface of a grain oriented electrical steel sheet having undergone finishing annealing, wherein the treatment solution contains a phosphate of at least one selected from the group consisting of Mg, Ca, Ba, Sr, Zn, Al and Mn, colloidal silica, and a Cr compound, wherein a colloidal silica content in the treatment solution in terms of solid content is 50 to 150 parts by mass with respect to 100 parts by mass of total solids in the phosphate, wherein the Cr compound content in the treatment solution in terms of $CrO_3$ is 10 to 50 parts by mass with respect to 100 parts by mass of total solids in the phosphate, and wherein conditions of the baking in which a baking temperature T (unit: ° C.) ranges $800 \leq T \leq 1000$, a hydrogen concentration $H_2$ (unit: vol %) in a baking atmosphere ranges $0 \leq H_2 \leq 0.2$, and a baking time Time (unit: s) at the baking temperature T ranges $Time \leq 300$ are met, and wherein the plasma treatment is a treatment which includes irradiating an entire surface of the grain oriented electrical steel sheet after the baking with plasma generated from plasma gas containing at least 0.3 vol % to at most 5.0% of hydrogen for 0.10 seconds or more.

2. The method of manufacturing the grain oriented electrical steel sheet with an insulating coating according to claim 1, wherein the grain oriented electrical steel sheet having undergone finishing annealing and having the treatment solution applied thereto is retained at a temperature of 150 to 450° C. for 10 seconds or more before being subjected to the baking and the plasma treatment.

* * * * *